US008855544B2

(12) United States Patent
Namisaki et al.

(10) Patent No.: US 8,855,544 B2
(45) Date of Patent: Oct. 7, 2014

(54) IMAGE FORMING APPARATUS WITH CHARGE ELIMINATING GUIDE MEMBER

(75) Inventors: Kousuke Namisaki, Osaka (JP); Kohichi Yamauchi, Osaka (JP); Takashi Yamanaka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 45 days.

(21) Appl. No.: 13/414,209

(22) Filed: Mar. 7, 2012

(65) Prior Publication Data

US 2012/0230746 A1 Sep. 13, 2012

(30) Foreign Application Priority Data

Mar. 8, 2011 (JP) ..... 2011-050658
Mar. 9, 2011 (JP) ..... 2011-051271

(51) Int. Cl.
*G03G 15/00* (2006.01)
*G03G 15/20* (2006.01)

(52) U.S. Cl.
CPC ..... *G03G 15/2028* (2013.01)
USPC ..... 399/400; 399/397

(58) Field of Classification Search
CPC ... G03G 15/00; G03G 21/06; G03G 2221/00; B65H 2301/5133
USPC ..... 399/400, 397
See application file for complete search history.

(56) References Cited

U.S. PATENT DOCUMENTS 6,070,049 A 5/2000 Hayashida
7,680,449 B2 * 3/2010 Shimizu ..... 399/400

FOREIGN PATENT DOCUMENTS

JP 57-90659 A 6/1982
JP 2004-142871 A 5/2004
JP 2005-75505 A 3/2005
JP 2005-179034 A 7/2005
JP 2008-65255 A 3/2008
JP 2008-83368 A 4/2008
JP 2008-139490 A 6/2008
JP 2008-209699 A 9/2008
JP 2010-250054 A 11/2010
JP 2010250054 A * 11/2010

OTHER PUBLICATIONS

Machine translation of JP 2008-139490 Inventors: Keisuke Inoue, Yosuke Shimizu, Yoshihisa Fujimoto, and Noboru Yonekawa Date of publication: Jun. 19, 2008.*

* cited by examiner

*Primary Examiner* — Jill Culler
*Assistant Examiner* — John M Royston
(74) *Attorney, Agent, or Firm* — Birch, Stewart, Kolasch & Birch, LLP

(57) ABSTRACT

The present invention provides an image forming apparatus in which a recording paper to which a toner has been transferred is guided by a guide member and transported to a nip region between two rotatable members that are pressed against each other, and the toner on the recording paper is fixed at the nip region. In this image forming apparatus, a conductive or semiconductive region and an insulating region that are to be brought into contact with the recording paper are sequentially arranged in a recording paper transport direction on a guide face of the guide member, the conductive or semiconductive region is grounded, and the insulating region includes an end portion of the guide member oriented in the recording paper transport direction.

9 Claims, 10 Drawing Sheets

IMAGE FORMING APPARATUS WITH CHARGE ELIMINATING GUIDE MEMBER

BACKGROUND OF THE INVENTION

This application claims priority under 35 U.S.C. §119(a) on Patent Application Nos. 2011-050658 filed in Japan on Mar. 8, 2011, and 2011-051271 filed in Japan on Mar. 9, 2011, the entire contents of which are herein incorporated by reference.

The present invention relates to an image forming apparatus in which a recording paper to which a toner image has been transferred is guided by a guide member and transported to a nip region between rotatable members and the toner image is fixed to the recording paper at the nip region.

Examples of this sort of image forming apparatuses include electrographic apparatuses. In apparatuses of this type, an electrostatic latent image is formed on an image carrier, the electrostatic latent image on the image carrier is developed using a toner, and, thus, a toner image is formed on the image carrier. Then, the toner image formed on the image carrier is transferred from the image carrier to a recording paper, the recording paper is guided by a guide member so as to pass through a nip region between two rotatable members (rollers or rotatable belts), heat and pressure are applied to the recording paper at the nip region, and, thus, the toner image is fixed to the recording paper.

FIG. 12 is a cross-sectional view schematically showing the vicinity of a guide member and rotatable members. In FIG. 12, a fixing device 101 has a heat roller 102 and a pressure roller 103 (rotatable members), the heat roller 102 and the pressure roller 103 are caused to press each other forming a nip region N between the heat roller 102 and the pressure roller 103. A guide plate 104 (guide member) is disposed on the upstream side in a recording paper P transport direction of the nip region N.

After the toner image is transferred, the recording paper P is transported to the guide plate 104, guided by a guide face 104*a* of the guide plate 104, and sent along a transport direction F to the fixing device 101. The heat roller 102 is disposed on the path after the guide face 104*a* in the transport direction F (on the downstream side in the transport direction F), and, thus, the leading edge of the recording paper P abuts against the surface of the heat roller 102. Then, the leading edge of the recording paper P (the edge on the downstream side in the recording paper P transport direction) is moved and guided to the nip region N by the surface of the heat roller 102 that is rotating in the arrow direction, the recording paper P is conveyed through the nip region N and subjected to the application of heat and pressure, and, thus, the toner image is fixed to the recording paper P.

Here, the recording paper P is transported from the guide face 104*a* of the guide plate 104 to the surface of the heat roller 102, and moved and guided to the nip region N by the surface of the heat roller 102 that is rotating in the arrow direction. In the transportation of the recording paper P, a paper transport path S of the recording paper P from the guide plate 104 to the nip region N is curved. Accordingly, the recording paper P slides across an end portion 104*b* of the guide plate 104 and is introduced into the nip region N in a tensioned state, and, thus, the recording paper P is prevented from being creased at the nip region N.

Furthermore, for example, the guide plate 104 is a metal plate and conductive, and is grounded. When the recording paper P is moved across the guide face 104*a* of the guide plate 104 while keeping contact therewith, static electricity may be generated on the guide plate 104, or charge on the recording paper P (charge on the toner) may be shifted to the guide plate 104, but, since the guide plate 104 is grounded, the charge on the guide plate 104 flows out from the guide plate 104 to the grounded point, and the guide plate 104 is prevented from being charged. If the charge accumulates on the guide plate 104, spark discharge occurs between the recording paper P and the guide plate 104, and the toner image on the recording paper P is disarranged.

Examples of conventional techniques include a technique described in JP 2008-83368A in which a charge removal brush is disposed at a guide face of a guide member for guiding a recording paper, so that charge is effectively removed from the recording paper by the charge removal brush.

Furthermore, examples of conventional techniques also include a technique described in JP H11-109690A in which a contact portion that is charged to the same polarity as a toner through friction with a recording paper is disposed at a guide face of a transportation guide for guiding a recording paper, so that the toner on the recording paper is prevented from being disarranged.

Generally, after a toner image is formed on an image carrier, a recording paper is conveyed through a nip region between the image carrier and a transfer roller, and the toner image is transferred from the image carrier to a front face of the recording paper, and, thus, the toner on the image carrier is not directly transferred to a back face of the recording paper. However, when toner images are repeatedly transferred at the nip region between the image carrier and the transfer roller, some toner becomes attached to the transfer roller, and the toner on the transfer roller is transferred to the back face of the recording paper. Accordingly, in the configuration in which the recording paper P slides across the end portion 104*b* of the guide plate 104 as shown in FIG. 12, the back face of the recording paper may be rubbed against the end portion 104*b* of the guide plate 104, and a slight amount of toner attached to the back face of the recording paper may become attached to and accumulate on the end portion 104*b* of the guide plate 104.

In particular, when the guide plate 104 is grounded as shown in FIG. 12 in order to prevent spark discharge from occurring between the recording paper P and the guide plate 104, charge on the recording paper P (charge on the toner) flows out via the guide plate 104, and the charge on the toner is reduced, and, thus, the toner on the back face of the recording paper P easily becomes attached to the end portion 104*b* of the guide plate 104, and the notable phenomenon occurs in which the toner becomes attached to and accumulates on the end portion 104*b* of the guide plate 104.

Then, when a trailing edge of the recording paper P slides across the end portion 104*b* of the guide plate 104, the toner attached to and accumulating on the end portion 104*b* of the guide plate 104 is transferred back to the trailing edge, and the trailing edge of the recording paper P is smeared.

Conventionally, such a toner attached to and accumulating on the end portion 104*b* of the guide plate 104 is left as it is, and this problem cannot be prevented.

For example, the charge removal brush in JP 2008-83368A or the contact portion in JP H11-109690A cannot prevent a toner from becoming attached to or accumulating on the end portion 104*b* of the guide plate 104.

The present invention was made in view of the above-described conventional problem, and it is an object thereof to provide an image forming apparatus in which a toner on a back face of a recording paper can be prevented from becoming attached to and accumulating on an end portion of a guide plate.

SUMMARY OF THE INVENTION

In order to solve the above-described problem, the present invention is directed to an image forming apparatus, wherein a recording paper to which a toner has been transferred is guided by a guide member and transported to a nip region between two rotatable members that are pressed against each other and the toner on the recording paper is fixed at the nip region, a conductive or semiconductive region and an insulating region that are to be brought into contact with the recording paper are sequentially arranged in a recording paper transport direction on a guide face of the guide member, the conductive or semiconductive region is grounded, and the insulating region includes an end portion of the guide member oriented in the recording paper transport direction (an end portion on the downstream side in the transport direction of the guide member).

In the image forming apparatus of the present invention, the conductive or semiconductive region and the insulating region are sequentially arranged in the recording paper transport direction on the guide face of the guide member. Accordingly, the recording paper is first brought into contact with the conductive or semiconductive region of the guide face, and then with the insulating region of the guide face.

Since the conductive or semiconductive region on one side is grounded, even when the recording paper slides across the conductive or semiconductive region, and static electricity is generated in this region or charge on the recording paper (charge on the toner) is shifted to this region, the charge on this region flows out to the grounded point. Accordingly, the conductive or semiconductive region is prevented from being charged.

Furthermore, since the insulating region on the other side on the guide face of the guide member includes an end portion of the guide member oriented in the recording paper transport direction, when the recording paper is sent away from the end portion of the guide member (the end portion of the insulating region), the charge (the charge on the toner) does not flow out from the recording paper to the insulating region, and the toner on the recording paper hardly becomes attached to the end portion of the guide member.

In particular, when the semiconductive region is used, flowing out of the charge on the recording paper (the charge on the toner) is suppressed, and, thus, even when the recording paper is sent away from the end portion of the guide member, a large amount of charge remains on the recording paper, and it is more difficult for the toner on the recording paper to be transferred to the end portion of the guide member.

Furthermore, in the image forming apparatus of the present invention, the insulating region may be made of an insulating layer or an insulating sheet, and the conductive or semiconductive region may be made of a conductive or semiconductive layer or sheet.

Moreover, in the image forming apparatus of the present invention, the conductive or semiconductive region may be made of a flexible sheet that is conductive or semiconductive, and the guide member may have a support face for supporting the flexible sheet, a step may be provided between the support face of the guide member and the insulating region, and the flexible sheet may be projected in the recording paper transport direction from the step.

In this case, when the recording paper is transported from the flexible sheet to the insulating region, the flexible sheet is bowed from above the step toward the insulating region below, and the flexible sheet smoothly transports the recording paper. Furthermore, even if the toner on the back face of the recording paper becomes attached to the end portion of the flexible sheet, the amount of toner attached is slight, and, when the flexible sheet springs back to its original shape due to the elastic repulsive force thereof, the slight amount of toner attached to the end portion of the flexible sheet is shaken off.

Furthermore, in the image forming apparatus of the present invention, the flexible sheet may be projected to a point above the insulating region. That is to say, the flexible sheet may be disposed above the insulating region.

In this case, when the flexible sheet is bowed from above the step to below, the front end of the flexible sheet is brought close to or into contact with the insulating region, and, thus, the flexible sheet more smoothly transports the recording paper.

Furthermore, in order to solve the above-described problem, the present invention is directed to an image forming apparatus, wherein a recording paper to which a toner has been transferred is guided by a guide member and transported to a nip region between two rotatable members that are pressed against each other and the toner on the recording paper is fixed at the nip region, a flexible sheet that is to be brought into contact with the recording paper and that is conductive or semiconductive is disposed on a guide face of the guide member, the flexible sheet is projected in a recording paper transport direction from an end (end portion) of the guide member, and the flexible sheet is grounded.

In the image forming apparatus of the present invention, the conductive or semiconductive flexible sheet is disposed on the guide face of the guide member, and the flexible sheet is projected in the recording paper transport direction from the end (the end portion) of the guide member. The projected portion of the flexible sheet projected in the recording paper transport direction from the end of the guide member is a portion that can be curved freely, and is curved with the recording paper or along the transport path due to the contact pressure of the recording paper. Accordingly, the recording paper is not rubbed hard against the projected portion of the flexible sheet, and the toner on the back face of the recording paper does not become attached to the end portion of the flexible sheet. Furthermore, even if the toner on the back face of the recording paper becomes attached to the end portion of the flexible sheet, the amount of toner attached is slight, and, when the flexible sheet springs back to its original shape due to the elastic repulsive force thereof, the slight amount of toner attached to the end portion of the flexible sheet is shaken off. Moreover, the recording paper slides across the projected portion of the flexible sheet and is introduced into the nip region in a tensioned state, and, thus, the recording paper is prevented from being creased at the nip region.

Furthermore, since the flexible sheet is conductive or semiconductive, and the flexible sheet is grounded, even when the recording paper is moved while in contact with the flexible sheet, and static electricity is generated on the flexible sheet or charge on the recording paper (charge on the toner) is shifted to the flexible sheet, the charge on the flexible sheet flows out to the grounded point, and, thus, the flexible sheet is prevented from being charged.

Moreover, the semiconductive flexible sheet does not cause charge on the recording paper (charge on the toner) to completely flow out, and causes charge on the toner on the recording paper to remain, and, thus, it is difficult for the toner on the recording paper to be transferred to the flexible sheet.

Furthermore, in the image forming apparatus of the present invention, at least one of the rotatable members may be a heat roller having a built-in heat source, and the flexible sheet may have a heat resistance of at least the surface temperature of the heat roller.

In this case, even when the flexible sheet is extended up to a point close to the surface of the heat roller, the flexibility can be maintained.

Moreover, in the image forming apparatus of the present invention, the flexible sheet may be projected toward a surface of one of the rotatable members from the end (the end portion) of the guide member.

In this case, the leading edge of the recording paper is transported to the surface of the rotatable member, and guided to the nip region by the surface of the rotatable member that is rotating, and, thus, the transport path of the recording paper from the guide member to the nip region is curved, and the recording paper is also curved.

Furthermore, in the image forming apparatus of the present invention, the guide member may be formed by overlaying two conducting plates on each other, the flexible sheet may be disposed on the guide face of one of the conducting plates, electrical continuity may be established between the conducting plates by folding and holding part of the flexible sheet between the conducting plates, and the flexible sheet may be grounded via the conducting plates.

Accordingly, the flexible sheet can be grounded via the guide member.

Moreover, in the image forming apparatus of the present invention, the flexible sheet may be disposed at least at a region with which the recording paper can be brought into contact, in an entire region on the guide face of the guide member, and the entire front face of the flexible sheet may be a smooth face.

Accordingly, the recording paper can be guided by the flexible sheet without becoming stuck, and the toner on the back face of the recording paper is not transferred to and left on the flexible sheet.

DESCRIPTION OF REFERENCE NUMERALS

Figure 1:
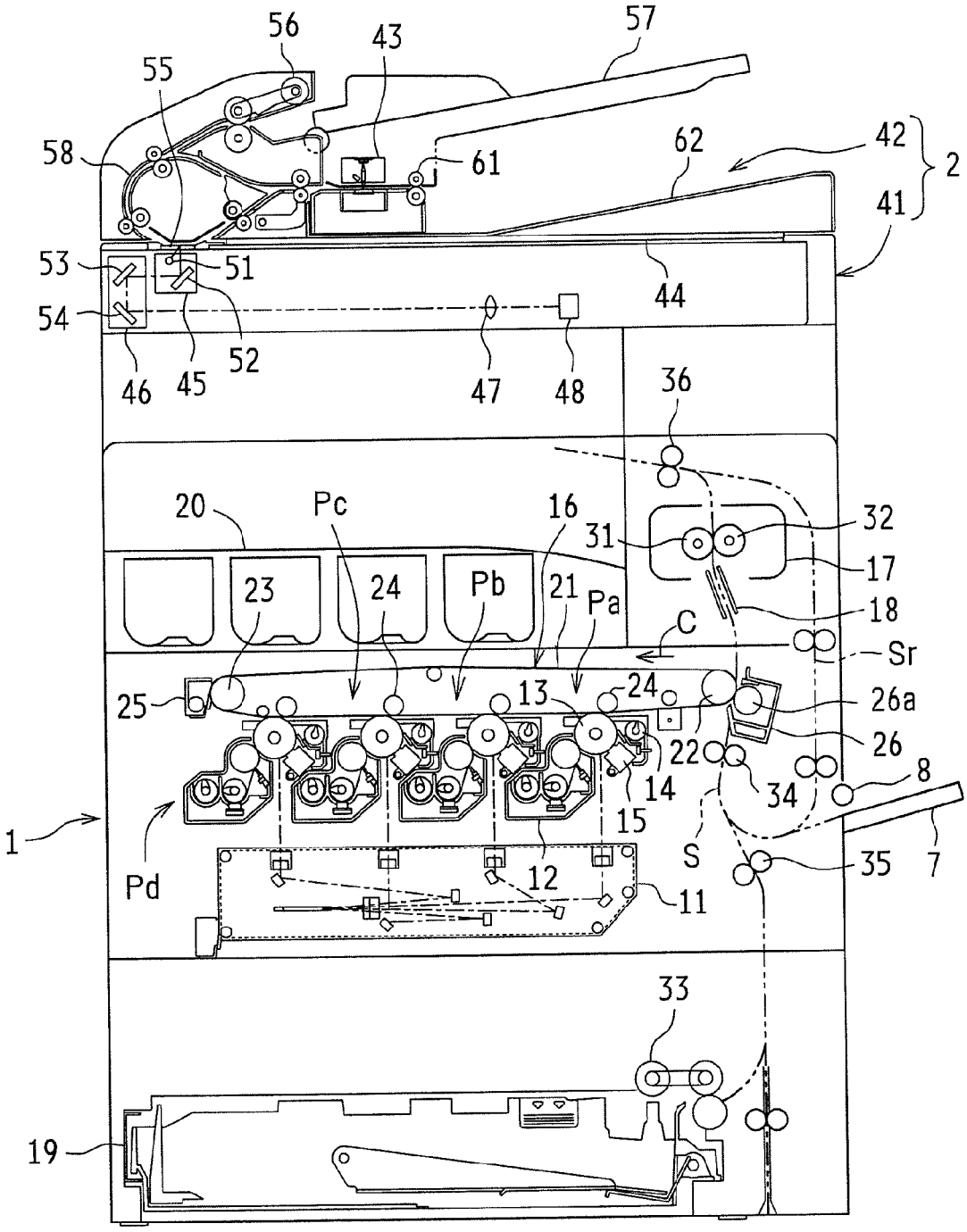
FIG. 1 is a cross-sectional view showing an embodiment of an image forming apparatus of the present invention.

1 Image forming apparatus
2 Document reading apparatus
11 Laser exposure device
12 Development device
13 Photosensitive drum
14 Cleaner device
15 Charging unit
16 Intermediate transfer belt device
17 Fixing device
18 Guide portion
19 Paper feed tray
20 Paper discharge tray
71 Guide plate (guide member)
72 Guide plate
73 Flexible sheet
74 Main metal plate
75 Sub metal plate
77 Insulating layer
J Semiconductive region
Q Insulating region

DESCRIPTION OF THE EMBODIMENTS

Hereinafter, embodiments of the present invention will be described in detail with reference to the appended drawings.

FIG. 1 is a cross-sectional view showing an embodiment of an image forming apparatus of the present invention. An image forming apparatus 1 is a so-called multifunction peripheral having a scanner function, a copier function, a printer function, a facsimile function, and the like. The image forming apparatus 1 transmits an image of a document read by a document reading apparatus 2 to the outside of the apparatus, and forms and records an image of the read document or an image received from the outside of the apparatus in color or monochrome on a recording paper P (see FIG. 2).

The image forming apparatus 1 is provided with a manual feed tray 7, a laser exposure device 11, development devices 12, photosensitive drums 13, cleaner devices 14, charging units 15, an intermediate transfer belt device 16, a fixing device 17, a guide portion 18, a paper transport path S, a paper feed tray 19, a paper discharge tray 20, and the like, in order to print an image on the recording paper P.

Image data processed in the image forming apparatus 1 corresponds to a color image using colors consisting of black (K), cyan (C), magenta (M), and yellow (Y), or corresponds to a monochrome image using a monochrome color (e.g., black). Accordingly, four development devices 12, four photosensitive drums 13, four cleaner devices 14, and four charging units 15 are arranged so as to form four types of toner images corresponding to the respective colors. These four constituent elements respectively correspond to black, cyan, magenta, and yellow, and four image stations Pa, Pb, Pc, and Pd are formed.

The photosensitive drums 13 have photosensitive layers on their surfaces. The charging units 15 are charging means for uniformly charging the surfaces of the photosensitive drums 13 to a predetermined potential, and may be a contact-type charging unit using a roller or brush, or a charger-type charging unit.

The laser exposure device 11 is a laser scanning unit (LSU) provided with laser diodes and reflecting mirrors, and causes the charged surfaces of the photosensitive drums 13 to be exposed to light according to image data to form electrostatic latent images corresponding to the image data on the surfaces.

The development devices 12 develop the electrostatic latent images formed on the surfaces of the respective photosensitive drums 13 using toners of the respective colors, and form toner images on the surfaces of the photosensitive drums 13. The cleaner devices 14 remove and recover toners left on the surfaces of the photosensitive drums 13 after development and image transfer.

The intermediate transfer belt device 16 is disposed above the photosensitive drums 13, and provided with an intermediate transfer belt 21, an intermediate transfer belt driving roller 22, an idler roller 23, four intermediate transfer rollers 24, and an intermediate transfer belt cleaning device 25.

The intermediate transfer belt 21 is obtained by forming a film having a thickness of approximately 100 μm to 150 μm into an endless belt. The intermediate transfer belt driving roller 22, the idler roller 23, the intermediate transfer rollers 24, and the like support the intermediate transfer belt 21 in a tensioned state, and circumferentially move the intermediate transfer belt 21 in the arrow C direction.

The intermediate transfer rollers 24 are supported in a rotatable manner near the intermediate transfer belt 21, and pressed via the intermediate transfer belt 21 against the respective photosensitive drums 13.

The toner images on the surfaces of the photosensitive drums 13 are sequentially transferred and superimposed on the intermediate transfer belt 21, and a color toner image is formed on the intermediate transfer belt 21. The toner images are transferred from the respective photosensitive drums 13 to the intermediate transfer belt 21, using the intermediate transfer rollers 24 pressed against the back face of the intermediate transfer belt 21. In order to transfer the toner images, a high-voltage transfer bias (a high voltage of the opposite polarity (+) to the charge polarity (−) of the toner) is applied to the intermediate transfer rollers 24.

In this manner, the toner images on the surfaces of the photosensitive drums 13 are superimposed on the intermediate transfer belt 21, and form a color toner image represented by the image data. This color toner image is transported together with the intermediate transfer belt 21, and transferred to the recording paper P at a nip region between the intermediate transfer belt 21 (more specifically, the intermediate transfer belt driving roller 22 via the intermediate transfer belt 21) and a transfer roller 26*a* of a secondary transfer device 26. A voltage (a high voltage of the opposite polarity (+) to the charge polarity (−) of the toner) for transferring the toner image of the above-described colors on the intermediate transfer belt 21 to the recording paper P is applied to the transfer roller 26*a* of the secondary transfer device 26.

The toner image on the intermediate transfer belt 21 may not be completely transferred by the secondary transfer device 26 to the recording paper P, and the toner may be left on the intermediate transfer belt 21. This residual toner causes toner color mixing in the following processes. Accordingly, the residual toner is removed and recovered by the intermediate transfer belt cleaning device 25.

After the color toner image is transferred at the nip region between the intermediate transfer belt 21 and the transfer roller 26*a* of the secondary transfer device 26, the recording paper P is transported via the guide portion 18 to the fixing device 17. The fixing device 17 is provided with a heat roller 31, a pressure roller 32, and the like, and the recording paper P is sandwiched between the heat roller 31 and the pressure roller 32 and transported.

The heat roller 31 is controlled so as to be at a predetermined fixing temperature. The heat roller 31 and the pressure roller 32 apply thermo-compression to the recording paper P, and thus melt, mix, and press the color toner image transferred to the recording paper P, and thermally fix the color toner image to the recording paper P.

Meanwhile, the image forming apparatus 1 includes a paper feed tray 19 and a manual feed tray 7 that feed the recording paper P, and a paper transport path S that transports the recording paper P via the secondary transfer device 26 and the fixing device 17 to the paper discharge tray 20. Along the paper transport path S, paper registration rollers 34, the fixing device 17, transport rollers 35, paper discharge rollers 36, and the like are arranged.

The paper feed tray 19 is a tray in which the recording papers P are stored, and is disposed in the lower portion of the image forming apparatus 1. At an end portion of the paper feed tray 19, paper pickup rollers 33 are arranged, and the recording papers P are drawn out sheet by sheet by the paper pickup rollers 33 from the paper feed tray 19 and transported into the paper transport path S. Furthermore, the manual feed tray 7 is a tray in which recording papers P are placed, and is disposed at a side wall of the image forming apparatus 1. At an end portion of the manual feed tray 7, a pickup roller 8 is disposed, and the recording papers P are drawn out sheet by sheet by the pickup roller 8 from the manual feed tray 7 and transported into the paper transport path S.

The transport rollers 35 are a plurality of pairs of small rollers for promoting and assisting transportation of the recording paper P.

The paper registration rollers 34 temporarily stop the recording paper P that has been transported, adjust the position of the leading edge of the recording paper P, and transport the recording paper P in synchronization with the rotation of the photosensitive drums 13 and the intermediate transfer belt 21 so that the color toner image on the intermediate transfer belt 21 is transferred to the recording paper P at the nip region between the intermediate transfer belt 21 and the transfer roller 26*a* of the secondary transfer device 26.

Moreover, after the color toner image is fixed at the fixing device 17, the recording paper P passes through the fixing device 17, and is then discharged facedown by the paper discharge rollers 36 onto the paper discharge tray 20.

Furthermore, when performing printing on both the front face and the back face of the recording paper P, the paper discharge rollers 36 on the paper transport path S are stopped and then rotated in reverse during transportation of the recording paper P by the paper discharge rollers 36, the recording paper P is passed along a reverse path Sr where the front and the back of the recording paper P are reversed, and then the recording paper P is guided to the paper registration rollers 34. Subsequently, as in the case of the front face of the recording paper P, an image is recorded and fixed to the back face of the recording paper P, and the recording paper P is discharged onto the paper discharge tray 20.

Next, the document reading apparatus 2 mounted above the main body of the image forming apparatus 1 will be described. The document reading apparatus 2 is provided with a first reading portion 41 on the lower side and a document transporting portion 42 on the upper side. An inner side of the document transporting portion 42 is axially supported by a hinge (not shown) on an inner side of the first reading portion 41, and the document transporting portion 42 is opened or closed by lifting or lowering an outer side portion thereof. When the document transporting portion 42 is opened, a glass platen 44 of the first reading portion 41 is exposed, and a document is placed on the glass platen 44.

The first reading portion 41 is provided with the glass platen 44, a first scanning unit 45, a second scanning unit 46, an imaging lens 47, a charge coupled device (CCD) 48, and the like. The first scanning unit 45 is provided with a light source 51 and a first reflecting mirror 52. While the first scanning unit 45 is moving at a constant velocity V by a distance according to the document size in a sub-scanning direction, the document surface on the glass platen 44 is illuminated by the light source 51, and the reflected light is reflected by the first reflecting mirror 52 and guided to the second scanning unit 46, and, thus, the image on the document surface is scanned in the sub-scanning direction. The second scanning unit 46 is provided with second and third reflecting mirrors 53 and 54. While the second scanning unit 46 is moving following the first scanning unit 45 at a velocity V/2, the reflected light from the document is reflected by the second and the third reflecting mirrors 53 and 54 and guided to the imaging lens 47. The imaging lens 47 converges the reflected light from the document onto the CCD 48, and forms the image on the document surface on the CCD 48. The CCD 48 repeatedly scans the image on the document surface in a main-scanning direction, and outputs analog image signals for one main scanning line after each scan.

Furthermore, the first reading portion 41 can read not only a document that is stationary but also an image on the surface of a document that is being transported by the document transporting portion 42. In this case, as shown in FIG. 1, the first scanning unit 45 is moved to a reading position below a document reading glass 55, and the second scanning unit 46 is positioned according to the position of the first scanning unit 45. Then, in this state, the document transporting portion 42 starts to transport the document.

In the document transporting portion 42, a pickup roller 56 is pressed against a document on a document tray 57 and rotated, the document is drawn out and transported through a document transport path 58, and, then, the document is passed over the document reading glass 55 of the first reading portion 41 and then below a second reading portion 43 and is transported from a paper discharge roller pair 61 to a paper discharge tray 62.

While the document is being transported, the light source 51 of the first scanning unit 45 illuminates the document surface via the document reading glass 55, the reflected light from the document is guided by the reflecting mirrors of the first and the second scanning units 45 and 46 to the imaging lens 47 and converged by the imaging lens 47 onto the CCD 48, the image on the document surface is formed on the CCD 48 and the image on the document surface is read by the CCD 48.

Furthermore, at the same time as when an image on a front face of a document that is being transported by the document transporting portion 42 is read, the built-in second reading portion 43 in the document transporting portion 42 can read an image on a back face of the document. The second reading portion (hereinafter, referred to as a "CIS") 43 is a contact image sensor (CIS), and is disposed above the glass platen 44. The document that has been passed over the document reading glass 55 of the first reading portion 41 is passed below the CIS 43, and is discharged onto the paper discharge tray 62. While the document is being passed below the CIS 43, the CIS 43 illuminates the back face of the document, receives the reflected light from the document, and reads the image on the back face of the document.

The images of the document read by the CCD 48 and the CIS 43 in this manner are output from the CCD 48 and the CIS 43 as analog image signals, and the analog image signals are A/D converted into digital image signals. The digital image signals (image data) are subjected to various types of image processing, and then transmitted to the laser exposure device 11 of the image forming apparatus 1. The image forming apparatus 1 records the images on the recording papers P, and the recording papers P are output as copied documents.

Here, in the image forming apparatus 1, after toner images on the respective photosensitive drums 13 are transferred to the intermediate transfer belt 21, and a color toner image is formed on the intermediate transfer belt 21, the recording paper P is conveyed through the nip region between the intermediate transfer belt 21 and the transfer roller 26*a*, and the color toner image is transferred from the intermediate transfer belt 21 to a front face of the recording paper P, and, thus, the toner on the intermediate transfer belt 21 is not directly transferred to a back face of the recording paper P. However, when transfer is repeatedly performed from the photosensitive drums 13 to the intermediate transfer belt 21 and then to the recording paper P, a residual toner on the photosensitive drums 13 may be transferred to the intermediate transfer belt 21, or a residual toner may appear on the intermediate transfer belt 21 itself. In this state, when the recording paper P is not present at the nip region between the intermediate transfer belt 21 and the transfer roller 26*a*, the residual toner on the intermediate transfer belt 21 is transferred and becomes attached to the transfer roller 26*a*. Then, the toner attached to the transfer roller 26*a* is transferred to the back face of the recording paper P, and the recording paper P together with the toner on its back face is transported to the guide portion 18. A problem occurs if the toner on the back face of the recording paper P becomes attached to the guide portion 18.

Here, in this embodiment, the guide portion 18 is configured such that it is difficult for the toner on the back face of the recording paper P to become attached to the guide portion 18. Next, this guide portion 18 will be described in detail with reference to FIGS. 2 to 6.

Figure 2:
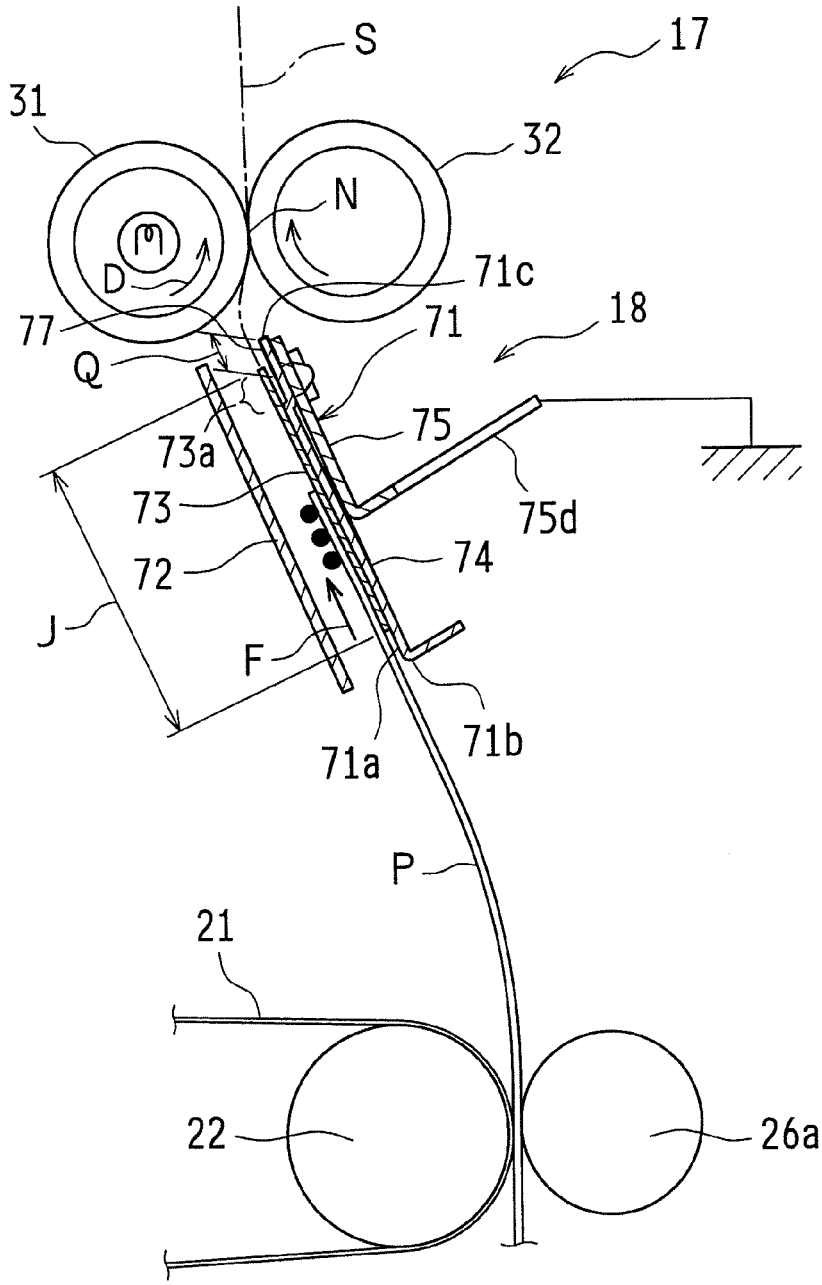
FIG. 2 is a cross-sectional view schematically showing a fixing device, a guide portion, and the like in the image forming apparatus in FIG. 1.

FIG. 2 is a cross-sectional view schematically showing the fixing device 17, the guide portion 18, and the like in the image forming apparatus 1. The guide portion 18 is disposed on the upstream side in the recording paper transport direction of the fixing device 17, and the intermediate transfer belt 21 and the transfer roller 26*a* are arranged further up the upstream side of the guide portion 18.

The fixing device 17 is provided with the heat roller 31 and the pressure roller 32. The heat roller 31 and the pressure roller 32 are axially supported such that they are pressed against each other, and the nip region N is formed between the rollers 31 and 32. For example, the pressure roller 32 is rotationally driven, and the heat roller 31 is idly rotated.

The heat roller 31 is a three-layered roller consisting of a metal core, an elastic layer that is disposed on the outer surface of the metal core, and a releasing layer that is disposed on the outer surface of the elastic layer. As the metal core, for example, a metal, such as steel, stainless steel, aluminum, or copper, or their alloy is used. As the elastic layer, a silicone rubber is used. As the releasing layer, a fluororesin such as PFA (a copolymer of tetrafluoroethylene and perfluoro(alkyl vinyl ether)) or PTFE (polytetrafluoroethylene) is used.

Furthermore, a heater lamp (halogen lamp) as a heat source that heats the heat roller 31 is disposed inside the heat roller 31 (inside the metal core).

The pressure roller 32, as well as the heat roller 31, is a three-layered roller consisting of a metal core that is made of, for example, a metal, such as steel, stainless steel, aluminum, or copper, or their alloy, an elastic layer that is disposed on the surface of the metal core and made of a silicone rubber or the like, and a releasing layer that is disposed on the surface of the elastic layer and made of PFA, PTFE, or the like.

In the guide portion 18 according to this embodiment, a pair of guide plates 71 and 72 are arranged so as to oppose each other, and a transport path of the recording paper P (part of the paper transport path S) is formed between the guide plates 71 and 72.

A semiconductive region J and an insulating region Q are sequentially arranged in the recording paper P transport direction F on a guide face 71*a* (a face opposing the guide plate 72) of the guide plate 71 on one side. The semiconductive region J is disposed so as to be sandwiched between both end portions 71*b* and 71*c* formed by extended in a direction orthogonal to the main-scanning direction (in the recording paper P transport direction F) of the guide plate 71, and is obtained by attaching a semiconductive flexible sheet 73 via a double-sided adhesive tape (not shown) to the guide face 71*a*. Furthermore, the insulating region Q includes the end portion 71*c* of the guide plate 71 oriented in the recording paper P transport direction F (the end portion on the downstream side in the transport direction F of the guide plate 71), and is obtained by forming an insulating layer 77 on the guide face 71*a*.

Furthermore, as the guide plate 71 is grounded, the flexible sheet 73 is grounded via the guide plate 71. Here, the flexible sheet 73 may be directly grounded, and the guide plate 71 may be grounded via the flexible sheet 73.

The guide plates 71 and 72 are, for example, made of a metal. Furthermore, the flexible sheet 73 is a flexible sheet having a thickness of approximately 60 to 80 μm, and is semiconductive (e.g., $1\times10^{8}$ to $1\times10^{12}$ [Ω·cm]). The flexible sheet 73 is, for example, a sheet made of a polyimide (PI) resin, a polyphenylene sulfide (PPS) resin, or a polytetrafluoroethylene (PFA) resin. Moreover, the insulating layer 77 is formed, for example, by partially coating the guide face 71*a* and its back face of the guide plate 71 with a polytetrafluoroethylene (PFA) resin.

Figure 3B:
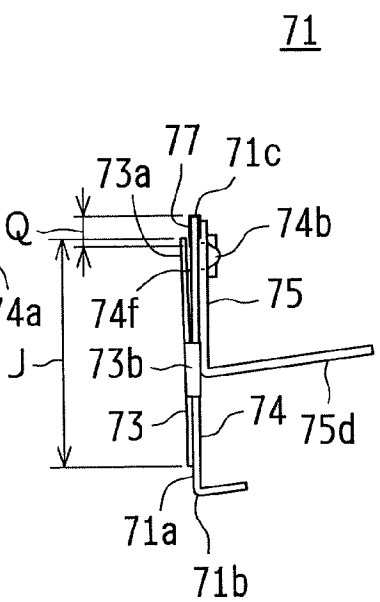
FIG. 3 includes FIGS. 3A and 3B, which respectively are a plan view and a side view showing a guide plate and the like of the guide portion in FIG. 2.
Figure 3A:
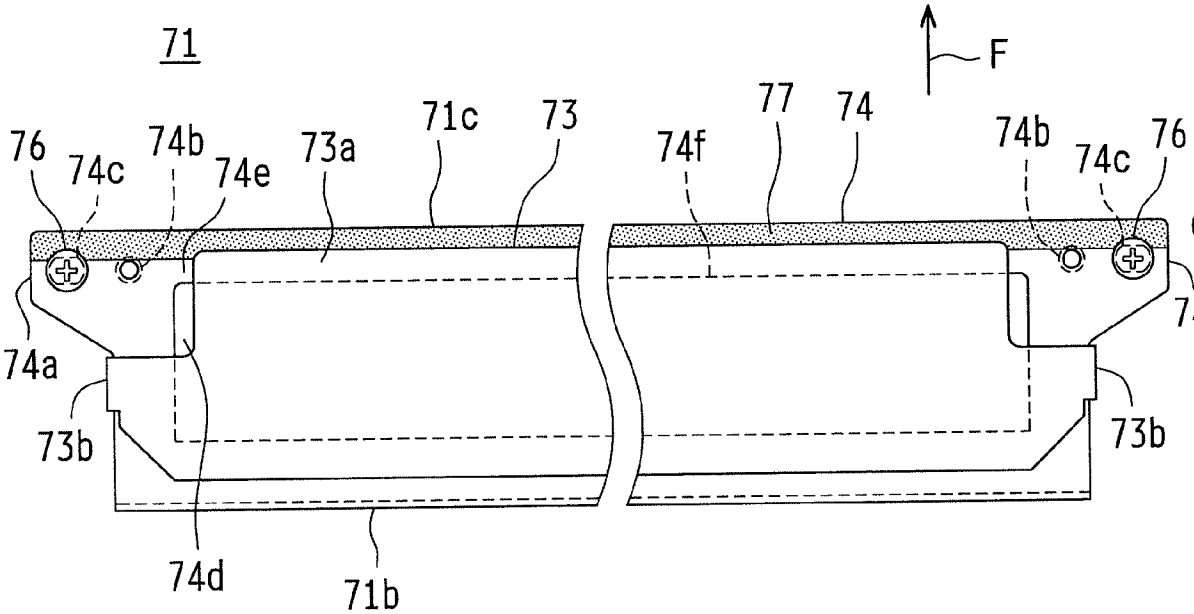

FIGS. 3A and 3B are a plan view and a side view showing the guide plate 71 and the flexible sheet 73. As shown in FIGS. 3A and 3B, the guide plate 71 is formed by overlaying and securing a main metal plate 74 opposing the guide plate 72 and a sub metal plate 75 on each other. The main metal plate 74 has a substantially L-shaped cross-section, and is long in a direction orthogonal to the recording paper P transport direction F (in the main-scanning direction). The length is larger than the maximum width of the recording paper P printed in the image forming apparatus 1. Protrusions 74*b* and holes 74*c* are respectively formed at end portions 74*a* on both sides in the main metal plate 74. Furthermore, a step portion 74*f* is formed on the front face (the guide face 71*a*) of the main metal plate 74. Since the step portion 74*f* is formed, an upper step portion 74*d* that is disposed over the step portion 74*f* and a lower step portion 74*e* that is disposed under the step portion 74*f* are formed in the main metal plate 74, and a step of approximately 0.5 mm is disposed between the upper step portion 74*d* and the lower step portion 74*e*.

The insulating region Q is a region having a length of approximately 3 mm in the recording paper P transport direction F, and includes the end portion of the main metal plate 74 (the end portion 71*c* of the guide plate 71) oriented in the recording paper P transport direction F. The insulating layer 77 forming the insulating region Q is continuously formed across the front face (the guide face 71*a*), the end face, and the back face of the main metal plate 74 in the vicinity of the end portion of the main metal plate 74 oriented in the transport direction F. That is to say, the insulating layer 77 covers the end portion on the downstream side in the recording paper P transport direction F of the main metal plate 74 (see the end portion 71*c* of the guide plate 71).

The semiconductive region J is a region extended from the upper step portion 74*d* to the lower step portion 74*e* of the main metal plate 74. The front face of the upper step portion 74*d* of the main metal plate 74 functions as a support face, the flexible sheet 73 forming the semiconductive region J is attached via a double-sided adhesive tape to the support face, a projected portion 73*a* of the flexible sheet 73 is projected by approximately 3 mm in the recording paper P transport direction F from the step portion 74*f*, and the front end of the projected portion 73*a* is extended up to a point immediately before the end portion of the main metal plate 74 oriented in the transport direction F and also includes a portion above the insulating layer 77. That is to say, part of the flexible sheet 73 (the end portion on the downstream side in the recording paper P transport direction F of the flexible sheet 73) is disposed above the insulating region Q.

The flexible sheet 73 includes at least a region that can be reached by the recording paper P, in the entire front face region of the main metal plate 74. The phrase "at least a region that can be reached by the recording paper P" refers to, with respect to the recording paper P transport direction F, a region that can be reached by the recording paper P that has been transported from the upstream side (a region on the front face of the main metal plate 74), and to, with respect to the main-scanning direction, a region through which the recording paper P having the maximum width that can be processed by the image forming apparatus 1 is passed. The entire front face of the flexible sheet 73 forms a smooth face or curved face such that no step or no unevenness is formed on it.

Figure 4:
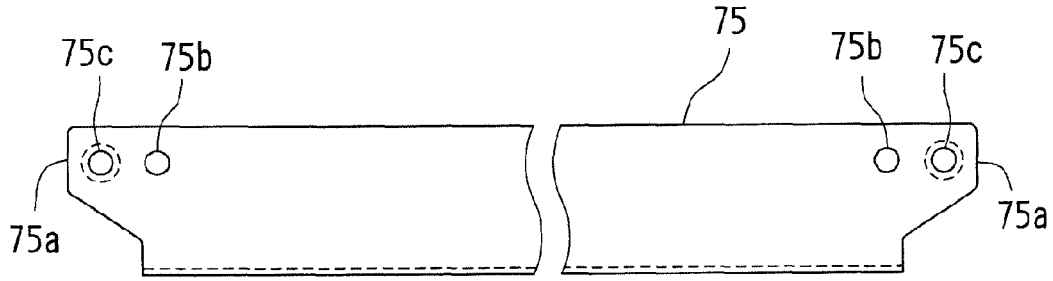
FIG. 4 is a plan view showing the sub metal plate in FIG. 3.

FIG. 4 is a plan view showing the sub metal plate 75. The sub metal plate 75 has an L-shaped cross-section and is substantially as long as the main metal plate 74, and holes 75*b* and screw holes 75*c* are respectively formed at end portions 75*a* on both sides of the sub metal plate 75, as shown in FIGS. 3B and 4.

Figure 5:
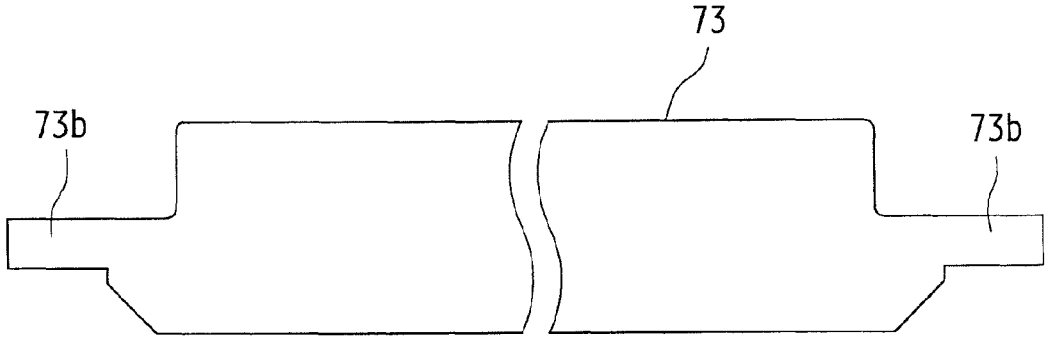
FIG. 5 is a view showing a flexible sheet of the guide plate in FIG. 3 unfolded flat.

FIG. 5 is a view showing the flexible sheet 73 unfolded flat. The flexible sheet 73 is longer than the main metal plate 74, and the bending portions 73*b* are projected from both ends of the flexible sheet 73, as shown in FIG. 5.

Here, in a state where the flexible sheet 73 is attached via a double-sided adhesive tape to the front face of the main metal plate 74 as shown in FIGS. 3A and 3B, the bending portions 73*b* on both sides of the flexible sheet 73 are folded toward the back face side of the main metal plate 74. Then, the sub metal plate 75 is overlaid on the back face of the main metal plate 74, the protrusions 74*b* on both sides of the main metal plate 74 are fitted to the holes 75*b* on both sides of the sub metal plate 75, so that the sub metal plate 75 is positioned with respect to the main metal plate 74, two screws 76 are screwed and fastened via the holes 74*c* on both sides of the main metal plate 74 into the screw holes 75*c* on both sides of the sub metal plate 75, the sub metal plate 75 is overlaid and secured on the main metal plate 74, and electrical continuity is established between the main metal plate 74 and the sub metal plate 75. Furthermore, the bending portions 73*b* on both sides of the flexible sheet 73 are held between the main metal plate 74 and the sub metal plate 75, and electrical continuity is established between the flexible sheet 73, and the main metal plate 74 and the sub metal plate 75. Accordingly, the main metal plate 74, the sub metal plate 75, and the flexible sheet 73 are integrated, and electrical continuity is established therebetween.

A stay 75*d* of the sub metal plate 75 is projected from the back side of the main metal plate 74 of the guide plate 71 described above, the stay 75*d* is secured to the main body frame of the image forming apparatus 1, so that the guide plate 71 is positioned, and the projected portion 73*a* of the flexible sheet 73 is disposed so as to be projected in the recording paper P transport direction F.

Furthermore, the orientation of the guide face 71*a* (the front face of the flexible sheet 73 and the front face of the insulating layer 77) is set such that the surface of the heat roller 31 is disposed on the path after the guide face 71*a* in the transport direction F, that is, in a direction in which the recording paper P is guided and sent along while sliding across the flexible sheet 73 and the insulating layer 77.

Moreover, the sub metal plate 75 is directly connected to the grounded point of the image forming apparatus 1, and the main metal plate 74 and the flexible sheet 73 are connected via the sub metal plate 75 to the grounded point.

In such a configuration, as shown in FIG. 2, after the toner image is transferred at the nip region between the intermediate transfer belt 21 and the transfer roller 26*a*, the recording paper P is transported to the guide portion 18, reaches the front face of the flexible sheet 73 of the guide plate 71 in the guide portion 18, is moved and guided across the front face of the flexible sheet 73, and, then, slides across the front face of the insulating layer 77 and is sent along the transport direction F.

When the recording paper P is sent away from the guide plate 71, since the surface of the heat roller 31 is disposed on the path of the transport direction, the leading edge of the recording paper P abuts against the surface of the heat roller 31. Moreover, the leading edge of the recording paper P is moved and guided to the nip region N by the surface of the heat roller 31 that is rotating in the arrow direction D, the recording paper P is conveyed through the nip region N and subjected to the application of heat and pressure, and, thus, the toner image is fixed to the recording paper P.

Here, the recording paper P is sent along the transport direction F from the guide face 71*a* of the guide plate 71 (the front face of the flexible sheet 73 and the front face of the insulating layer 77) to the surface of the heat roller 31, and guided to the nip region N by the surface of the heat roller 31 that is rotating in the arrow direction D, and, thus, the paper transport path S of the recording paper P from the guide face 71*a* to the nip region N is curved. Accordingly, the recording paper P slides across the end portion 71*c* of the guide plate 71 oriented in the transport direction F and is introduced into the nip region N in a tensioned state, and, thus, the recording paper P is prevented from being creased at the nip region N.

Note that sliding of the recording paper P on the guide plate 71 causes the toner on the back face of the recording paper P to become attached to the guide plate 71.

Figure 6:
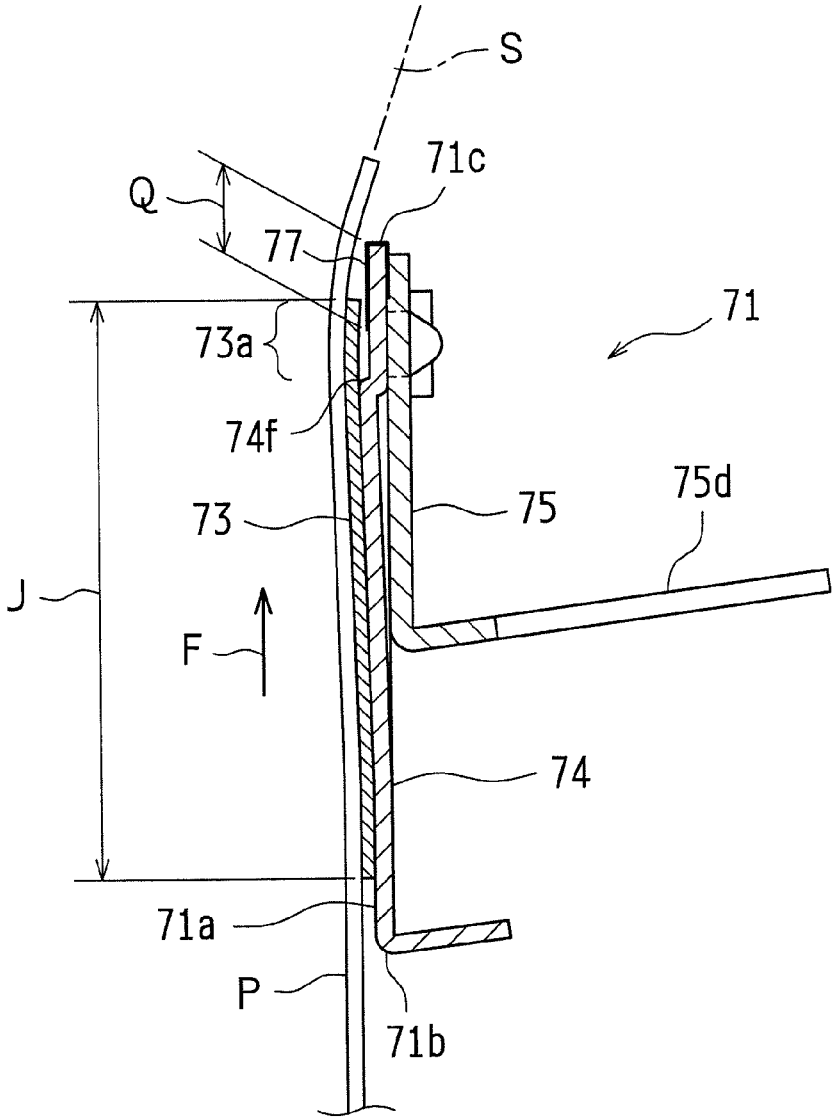
FIG. 6 is an enlarged cross-sectional view showing the vicinity of the flexible sheet of the guide plate in FIG. 3.

However, as shown in an enlarged view in FIG. 6, the projected portion 73*a* of the flexible sheet 73 is curved toward the insulating layer 77 due to the contact pressure of the recording paper P, and a smooth transport path of the recording paper P is formed from the projected portion 73*a* of the flexible sheet 73 to the insulating layer 77. That is to say, the flexible sheet 73 is attached to the support face of the upper step portion 74*d* of the main metal plate 74, the projected portion 73*a* of the flexible sheet 73 is projected by approximately 3 mm in the recording paper P transport direction F from the step portion 74*f*, and the front end of the projected portion 73*a* is extended to a point above the insulating layer 77, and, thus, the projected portion 73*a* of the flexible sheet 73 is curved toward the insulating layer 77 due to the contact pressure of the recording paper P, and a smooth transport path of the recording paper P is formed.

In such a smooth transport path, it is difficult for the toner on the back face of the recording paper P to become attached to the flexible sheet 73 or the insulating layer 77.

Furthermore, even when the toner on the back face of the recording paper P becomes attached to the end portion of the projected portion 73*a* of the flexible sheet 73, since the flexible sheet 73 is thin, the amount of toner attached to the end portion of the projected portion 73*a* is slight, and, when the flexible sheet 73 springs back to its original shape due to the elastic repulsive force thereof after the projected portion 73*a* of the flexible sheet 73 is curved toward the insulating layer 77 due to the contact pressure of the recording paper P, the slight amount of toner attached to the end portion of the projected portion 73*a* is shaken off.

Moreover, when the recording paper P slides across the front face of the flexible sheet 73, static electricity may be generated on the flexible sheet 73, or charge on the recording paper P (charge on the toner) may be shifted to the flexible sheet 73, but, since the semiconductive flexible sheet 73 is grounded via the guide plate 71, the charge on the flexible sheet 73 flows out to the grounded point. At that time, since the flexible sheet 73 is made of a semiconductive material (e.g., $1\times10^{8}$ to $1\times10^{12}$ [Ω·cm]), the amount of charge that flows out via the flexible sheet 73 is suppressed, the charge on the recording paper P (the charge on the toner) does not completely flow out rapidly via the flexible sheet 73 to the grounded point, and the charge on the recording paper P remains. Accordingly, it is difficult for the toner on the back face of the recording paper P to become attached to the front face of the flexible sheet 73.

Here, even when the amount of charge that flows out via the flexible sheet 73 is suppressed, excessive charge does not accumulate on the flexible sheet 73, and neither on the guide plate 71. Accordingly, spark discharge does not occur between the recording paper P and the flexible sheet 73 or the guide plate 71, and the toner image on the recording paper P is not disarranged by spark discharge.

Furthermore, since the charge on the recording paper P remains, and a current does not flow through the insulating layer 77 that is successively disposed after the flexible sheet 73, no charge (charge on the toner) flows out from the recording paper P to the insulating layer 77. Accordingly, even when the back face of the recording paper P slides across the end portion 71*c* of the guide plate 71 covered by the insulating layer 77, the toner on the back face of the recording paper P hardly is transferred and becomes attached to the end portion 71*c* of the guide plate 71.

That is to say, the transport path from the flexible sheet 73 to the insulating layer 77 is smooth, it is difficult for the toner on the back face of the recording paper P to become attached to the front face of the flexible sheet 73, and, when the recording paper P slides across the semiconductive flexible sheet 73, charge on the recording paper P (charge on the toner) remains, and, thus, it is more difficult for the toner on the back face of the recording paper P to become attached to the front face of the flexible sheet 73. Furthermore, even when the back face of the recording paper P subsequently slides across the end portion 71*c* of the guide plate 71 covered by the insulating layer 77, no charge (charge on the toner) flows out from the recording paper P to the insulating layer 77, and, thus, the toner on the back face of the recording paper P hardly is transferred and becomes attached to the end portion 71*c* of the guide plate 71. Accordingly, the toner on the back face of the recording paper P does not become attached to the guide plate 71 and does not cause the guide plate 71 to be smeared.

Note that, although the thus configured guide portion 18 was used in the foregoing embodiment, the guide portion 18 is not limited to the above-described configuration, and a guide portion 18 according to Embodiment 2 below also may be used.

Next, the guide portion 18 according to Embodiment 2 will be described with reference to the drawings. This guide portion 18 according to Embodiment 2 is different from that in the foregoing embodiment in the shape of the guide plate 71 on one side. Thus, in Embodiment 2, constituent elements having the same configuration as that in Embodiment 1 above are denoted by the same reference numerals, and a description thereof has been omitted. Hereinafter, the configuration different from that of Embodiment 1 will be described.

Figure 7:
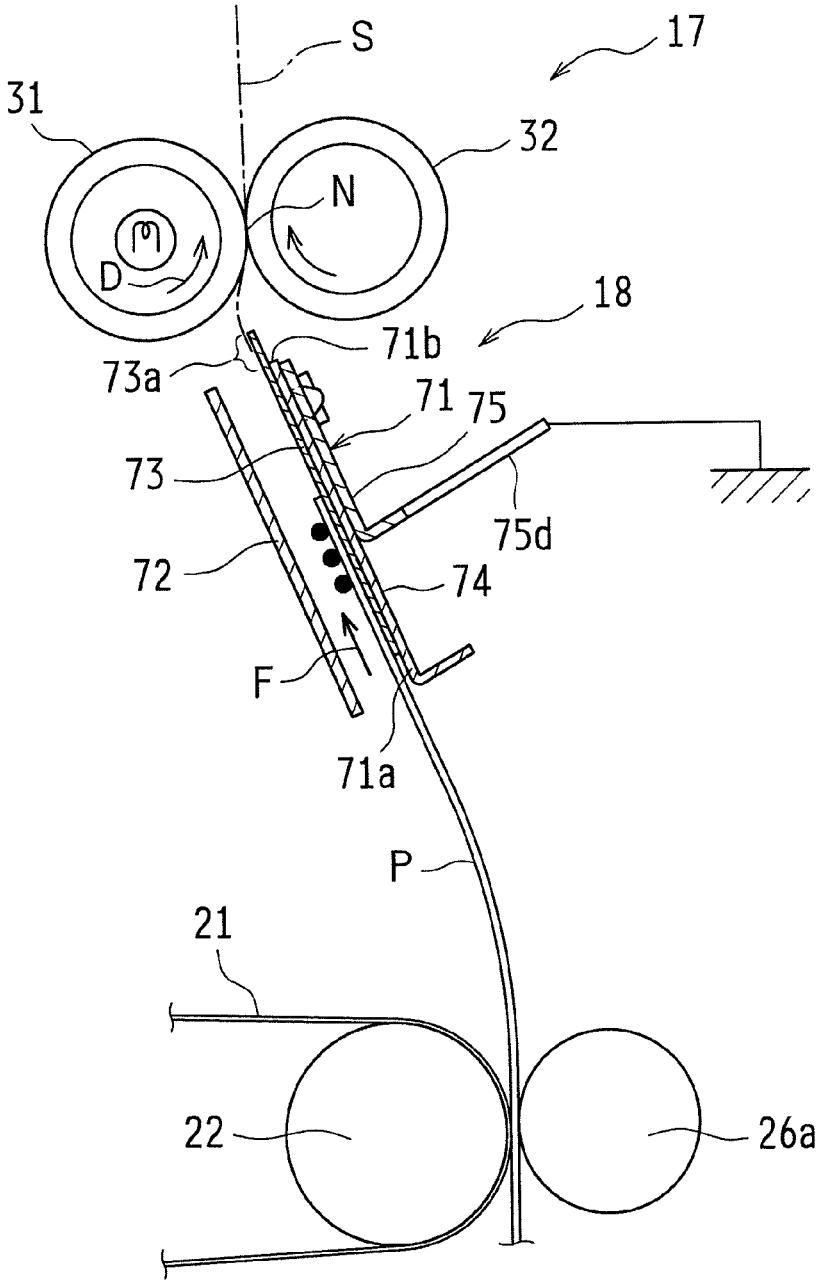
FIG. 7 is a cross-sectional view schematically showing a fixing device, a guide portion, and the like according to Embodiment 2.

FIG. 7 is a cross-sectional view schematically showing the fixing device 17, the guide portion 18, and the like in the image forming apparatus 1. The guide portion 18 is disposed on the upstream side in the recording paper transport direction of the fixing device 17, and the intermediate transfer belt 21 and the transfer roller 26*a* are arranged further up the upstream side of the guide portion 18.

In the guide portion 18, the pair of guide plates 71 and 72 are arranged so as to oppose each other, and a transport path of the recording paper P (part of the paper transport path S) is formed between the guide plates 71 and 72. Furthermore, the semiconductive flexible sheet 73 is attached via a double-sided adhesive tape (not shown) to the guide face 71*a* (a face opposing the guide plate 72) of the guide plate 71 on one side. The flexible sheet 73 has the projected portion 73*a* projected in the recording paper P transport direction F from the end portion 71*b* on the downstream side in the transport direction F of the guide plate 71 (the end 71*b* of the guide plate 71).

Furthermore, the guide plate 71 is grounded, and the flexible sheet 73 is grounded via the guide plate 71. Here, the flexible sheet 73 may be directly grounded, and the guide plate 71 may be grounded via the flexible sheet 73.

The guide plates 71 and 72 are, for example, made of a metal. Furthermore, the flexible sheet 73 is a flexible sheet having a thickness of approximately 60 to 80 μm, is semiconductive (e.g., $1\times10^{8}$ to $1\times10^{12}$ [Ω·cm]), and has a heat resistance of the maximum surface temperature (e.g., 185° C.) or more of the heat roller 31. For example, the flexible sheet 73 is made of a polyimide (PI) resin, a polyphenylene sulfide (PPS) resin, or a polytetrafluoroethylene (PFA) resin.

Here, the present inventors performed an experiment in which flexible sheets 73 having a heat resistance of 200° C. and respectively having volume resistivities of $1\times10^{8}$, $1\times10^{9}$, $1\times10^{10}$, and $1\times10^{12}$ [Ω·cm] were used, and, as a result thereof, a useful effect of Embodiment 2 as described later in detail, that is, a good effect was achieved in which charge on the recording paper P (charge on the toner) did not completely flow out via the flexible sheet 73, charge on the toner on the recording paper P remained, and, thus, it was difficult for the toner on the recording paper P to be transferred to the flexible sheet 73. Accordingly, the volume resistivity of the flexible sheet 73 is set to a range of $1\times10^{8}$ to $1\times10^{12}$ [Ω·cm].

Figure 8B:
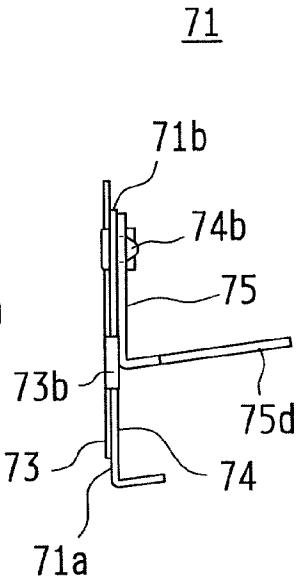
FIG. 8 includes FIGS. 8A and 8B, which respectively are a plan view and a side view showing a guide plate and the like of the guide portion in FIG. 7.
Figure 8A:
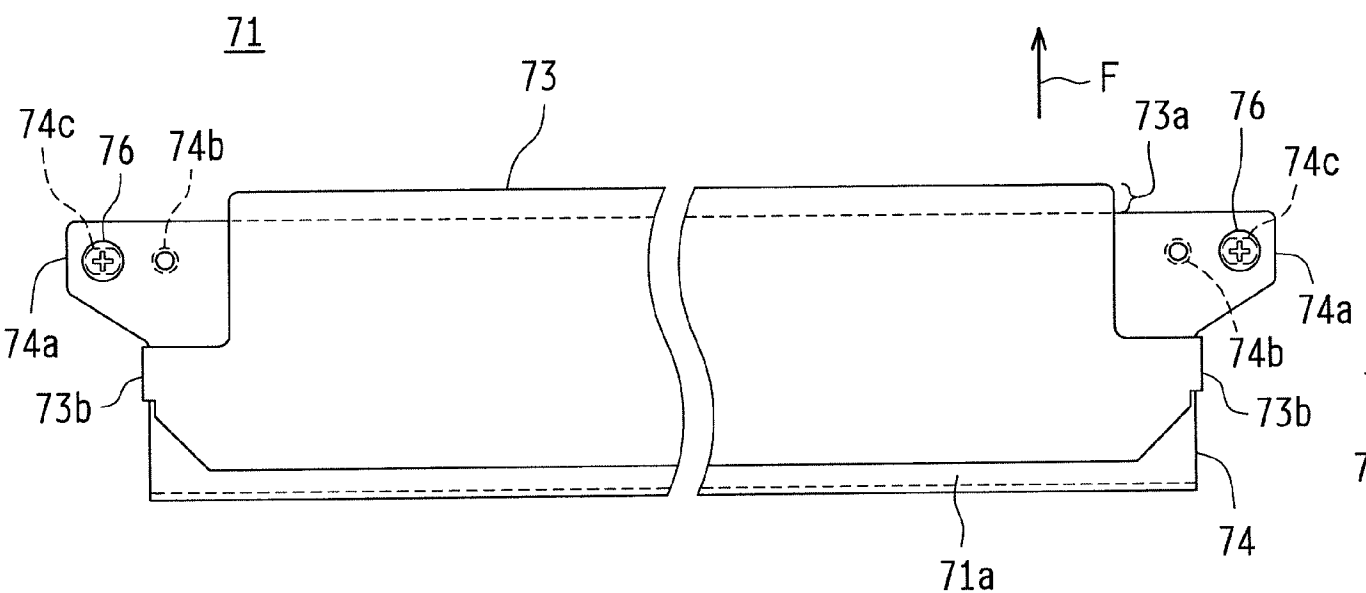

FIGS. 8A and 8B are a plan view and a side view showing the guide plate 71 and the flexible sheet 73. As shown in FIGS. 8A and 8B, the guide plate 71 is formed by overlaying and securing the main metal plate 74 opposing the guide plate 72 and the sub metal plate 75 on each other. The main metal plate 74 has an L-shaped cross-section, and is long in a direction orthogonal to the recording paper P transport direction F (in the main-scanning direction). The length is larger than the maximum width of the recording paper P printed in the image forming apparatus 1. The protrusions 74*b* and the holes 74*c* are respectively formed at the end portions 74*a* on both sides in the main metal plate 74. Furthermore, the sub metal plate 75 also has an L-shaped cross-section.

The flexible sheet 73 is attached via a double-sided adhesive tape (not shown) to the front face of the main metal plate 74 (the guide face 71*a* of the guide plate 71), and is disposed at least at a region with which the recording paper P can be brought into contact, in the entire front face region of the main metal plate 74. The phrase "at least a region with which the recording paper P can be brought into contact" refers to, with respect to the recording paper P transport direction F, a region from an arrival position of the recording paper P that has been transported from the upstream side (an arrival position on the front face of the main metal plate 74) to the end portion 71*b* on the downstream side in the transport direction F of the main metal plate 74 (the end 71*b* of the guide plate 71), and to, with respect to the main-scanning direction, a region through which the recording paper P having the maximum width that can be processed by the image forming apparatus 1 is passed. Moreover, only the projected portion 73*a* of the flexible sheet 73 is disposed so as to be projected by approximately 1 to 2 mm in the recording paper P transport direction F from the end portion 71*b* on the downstream side in the transport direction F of the main metal plate 74 (the end 71*b* of the guide plate 71). Then, at least from the region with which the recording paper P can be brought into contact to the projected portion 73*a*, the entire front face of the flexible sheet 73 forms a smooth face or curved face such that no step or no unevenness is formed on the entire front face of the flexible sheet 73.

Figure 9:
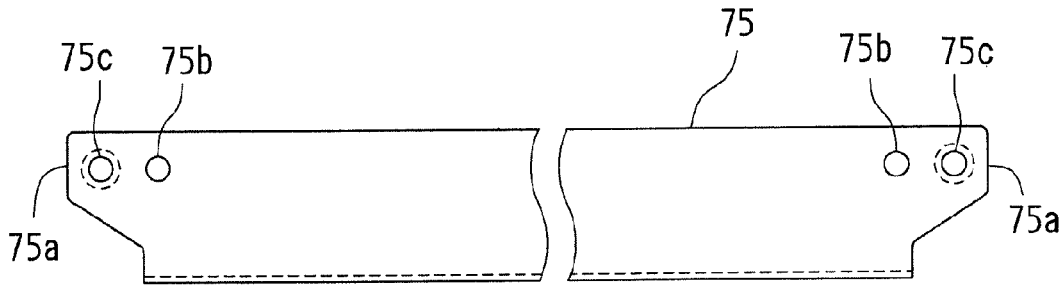
FIG. 9 is a plan view showing a sub metal plate of the guide plate in FIG. 8.

FIG. 9 is a plan view showing the sub metal plate 75. The sub metal plate 75 is substantially as long as the main metal plate 74, and the holes 75*b* and the screw holes 75*c* are respectively formed at the end portions 75*a* on both sides of the sub metal plate 75, as shown in FIG. 9.

Figure 10:
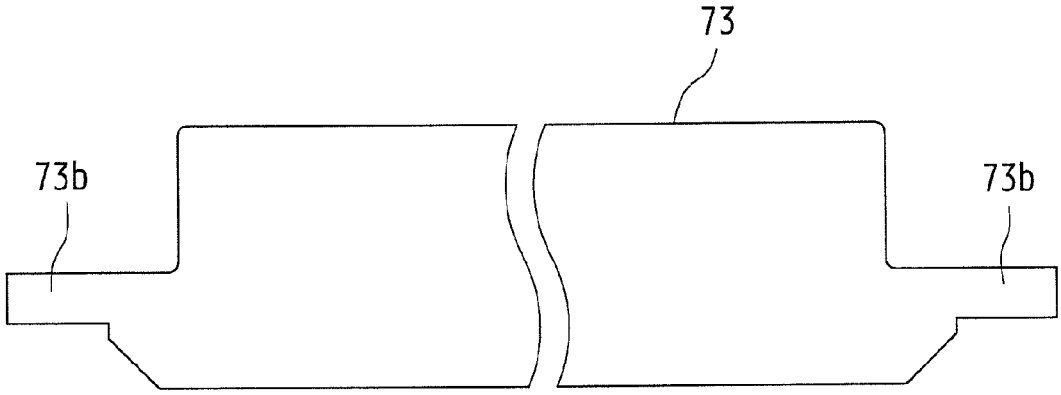
FIG. 10 is a view showing a flexible sheet of the guide plate in FIG. 8 unfolded flat.

FIG. 10 is a view showing the flexible sheet 73 unfolded flat. The flexible sheet 73 is longer than the main metal plate 74, and the bending portions 73*b* are projected from both ends of the flexible sheet 73, as shown in FIG. 10.

Here, in a state where the flexible sheet 73 is attached via a double-sided adhesive tape to the front face of the main metal plate 74 as shown in FIGS. 8A and 8B, the bending portions 73*b* on both sides of the flexible sheet 73 are folded toward the back face side of the main metal plate 74. Then, the sub metal plate 75 is overlaid on the back face of the main metal plate 74, the protrusions 74*b* on both sides of the main metal plate 74 are fitted to the holes 75*b* on both sides of the sub metal plate 75, so that the sub metal plate 75 is positioned with respect to the main metal plate 74, the two screws 76 are screwed and fastened via the holes 74*c* on both sides of the main metal plate 74 into the screw holes 75*c* on both sides of the sub metal plate 75, the sub metal plate 75 is overlaid and secured on the main metal plate 74, and electrical continuity is established between the main metal plate 74 and the sub metal plate 75. Furthermore, the bending portions 73*b* on both sides of the flexible sheet 73 are held between the main metal plate 74 and the sub metal plate 75, and electrical continuity is established between the flexible sheet 73, and the main metal plate 74 and the sub metal plate 75. Accordingly, the main metal plate 74, the sub metal plate 75, and the flexible sheet 73 are integrated, and electrical continuity is established therebetween.

The stay 75*d* of the sub metal plate 75 is projected from the back side of the main metal plate 74 of the guide plate 71 described above, the stay 75*d* is secured to the main body frame of the image forming apparatus 1, so that the guide plate 71 can be positioned, and the projected portion 73*a* of the flexible sheet 73 is disposed so as to be projected in the recording paper P transport direction F.

Furthermore, as shown in FIG. 7, the orientations of the guide face 71*a* of the guide plate 71 and the flexible sheet 73 are set such that the surface of the heat roller 31 is disposed on the path after the guide face 71*a* in the transport direction F, that is, in a direction in which the recording paper P is guided and sent along while sliding across the flexible sheet 73.

Moreover, the sub metal plate 75 is directly connected to the grounded point of the image forming apparatus 1, and the main metal plate 74 and the flexible sheet 73 are connected via the sub metal plate 75 to the grounded point.

In such a configuration, as shown in FIG. 7, after the toner image is transferred at the nip region N between the intermediate transfer belt 21 and the transfer roller 26*a*, the recording paper P is transported to the guide portion 18, reaches the front face of the flexible sheet 73 of the guide plate 71 in the guide portion 18, is moved and guided across the front face of the flexible sheet 73, and is sent along the transport direction F.

When the recording paper P is sent away from the guide plate 71, since the surface of the heat roller 31 is disposed on the path of the transport direction, the leading edge of the recording paper P abuts against the surface of the heat roller 31. Moreover, the leading edge of the recording paper P is moved and guided to the nip region N by the surface of the heat roller 31 that is rotating in the arrow direction D, the recording paper P is conveyed through the nip region N and subjected to the application of heat and pressure, and, thus, the toner image is fixed to the recording paper P.

Here, the recording paper P is sent along the transport direction F from the guide face 71*a* of the guide plate 71 (the front face of the flexible sheet 73) to the surface of the heat roller 31, and guided to the nip region N by the surface of the heat roller 31 that is rotating in the arrow direction D, and, thus, the paper transport path S of the recording paper P from the guide face 71*a* to the nip region N is curved. Accordingly, the recording paper P slides across the end portion of the guide plate 71 oriented in the transport direction F and is introduced into the nip region N in a tensioned state, and, thus, the recording paper P is prevented from being creased at the nip region N.

Note that sliding of the recording paper P on the guide plate 71 causes the toner on the back face of the recording paper P to become attached to the guide plate 71.

Figure 11:
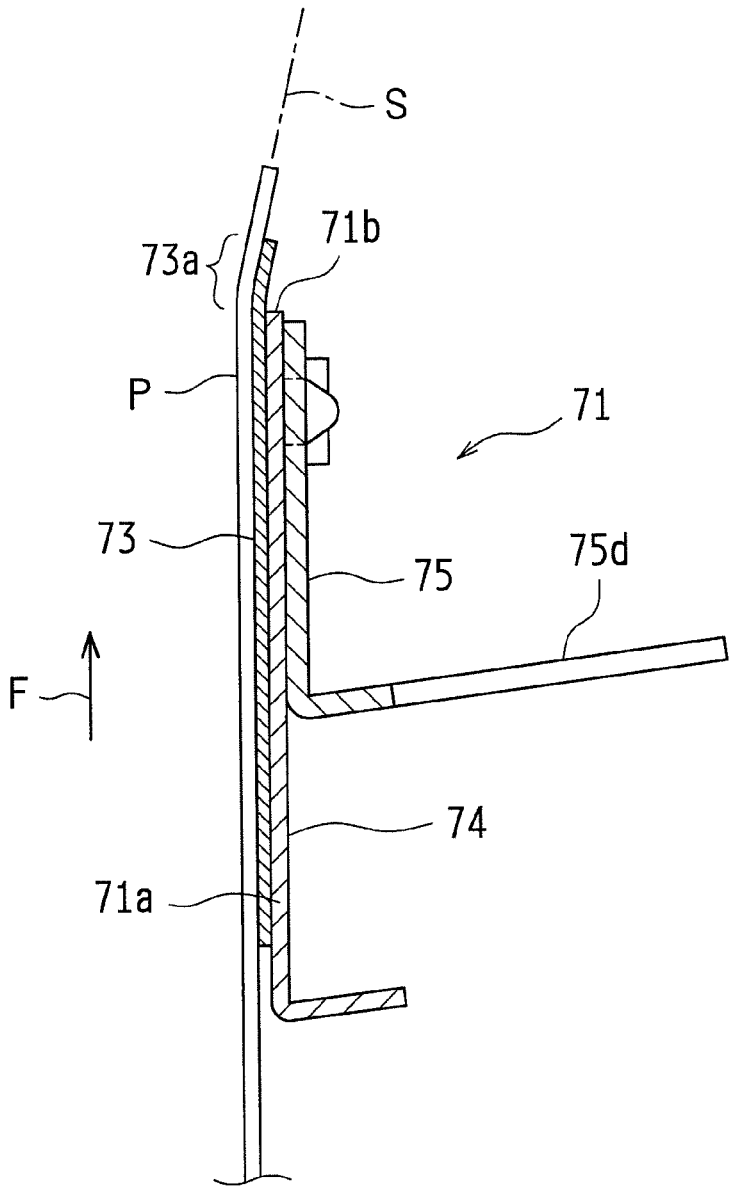
FIG. 11 is an enlarged view showing the vicinity of the flexible sheet of the guide plate in FIG. 8.
Figure 12:
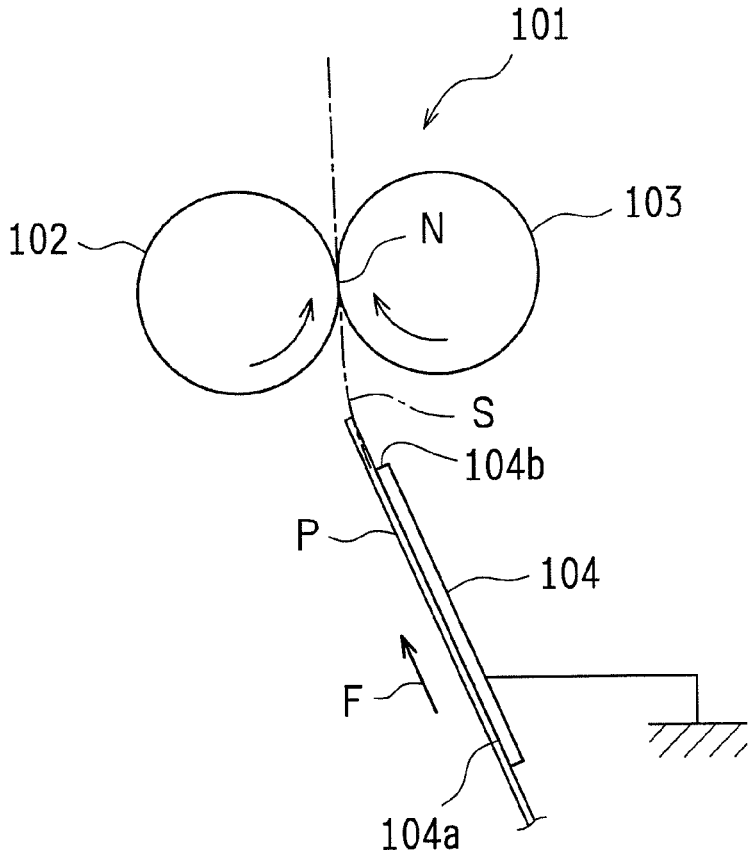
FIG. 12 is a cross-sectional view schematically showing a fixing device, a guide portion, and the like in a conventional image forming apparatus.

However, since the projected portion 73*a* of the flexible sheet 73 is projected from the end 71*b* of the guide plate 71, as shown in an enlarged view in FIG. 11, the projected portion 73*a* is curved with the recording paper P or along the paper transport path S due to the contact pressure of the recording paper P. Accordingly, the recording paper P is not rubbed hard against the projected portion 73*a* of the flexible sheet 73, and it is difficult for the toner on the back face of the recording paper P to become attached to the end portion of the projected portion 73*a* of the flexible sheet 73. Furthermore, even when the toner on the back face of the recording paper P becomes attached to the end portion of the projected portion 73*a* of the flexible sheet 73, since the flexible sheet 73 is thin, the amount of toner attached to the end portion of the projected portion 73*a* is slight, and, when the projected portion 73*a* springs back to its original shape due to the elastic repulsive force thereof, the slight amount of toner attached to the end portion of the projected portion 73*a* is shaken off.

Furthermore, as described above, the flexible sheet 73 is disposed at least at the region with which the recording paper P can be brought into contact, and the front face of the flexible sheet 73 forms a smooth face or curved face, and, thus, it is difficult for the toner on the back face of the recording paper P to become attached to the front face of the flexible sheet 73.

Moreover, when the recording paper P slides across the front face of the flexible sheet 73, static electricity may be generated on the flexible sheet 73, or charge on the recording paper P (charge on the toner) may be shifted to the flexible sheet 73, but, since the semiconductive flexible sheet 73 is grounded via the guide plate 71, the charge on the flexible sheet 73 flows out to the grounded point. At that time, since the flexible sheet 73 is made of a semiconductive material (e.g., $1\times10^{8}$ to $1\times10^{12}$ [Ω·cm]), the amount of charge that flows out via the flexible sheet 73 is suppressed, the charge on the recording paper P (the charge on the toner) does not completely flow out rapidly via the flexible sheet 73 to the grounded point, and the charge on the recording paper P remains. Accordingly, it is more difficult for the toner on the back face of the recording paper P to be transferred to the flexible sheet 73, and the guide plate 71 is not smeared.

Here, even when the amount of charge that flows out via the flexible sheet 73 is suppressed, excessive charge does not accumulate on the flexible sheet 73, and neither on the guide plate 71. Accordingly, spark discharge does not occur between the recording paper P and the flexible sheet 73 or the guide plate 71, and the toner image on the recording paper P is not disarranged by spark discharge.

That is to say, since the projected portion 73*a* is curved with the recording paper P or along the paper transport path S due to the contact pressure of the recording paper P, it is difficult for the toner on the back face of the recording paper P to become attached to the end portion of the projected portion 73*a* of the flexible sheet 73. Furthermore, since the front face of the flexible sheet 73 forms a smooth face or curved face, it is difficult for the toner on the back face of the recording paper P to become attached to the front face of the flexible sheet 73, and, when the recording paper P slides across the semiconductive flexible sheet 73, charge on the recording paper P (charge on the toner) remains, and, thus, it is more difficult for the toner on the back face of the recording paper P to become attached to the front face of the flexible sheet 73. Accordingly, the toner on the back face of the recording paper P does not become attached to the guide plate 71 and does not cause the guide plate 71 to be smeared.

Above, preferred embodiments were described with reference to the appended drawings, but of course the invention is not limited by those examples. It will be clear to those skilled in the art that within the category described in the claims, various modified or revised examples can be arrived at, and it will be understood that such examples also are naturally encompassed by the technical scope of the invention.

For example, a conductive flexible sheet may be used instead of the semiconductive flexible sheet. Even in the case of a conductive flexible sheet, there are a resistance of a recording paper, a contact resistance between a recording paper and the flexible sheet, and the like, and, thus, charge on the recording paper is not instantly shifted to a grounded point, and the charge on the recording paper remains. Accordingly, similar actions and effects can be obtained also in the case of a conductive flexible sheet.

Furthermore, in the foregoing embodiments, a nip region was formed between the heat roller and the pressure roller, but a nip region may be formed between the rotatable belt and the roller, and a toner on the recording paper may be fixed at this nip region.

What is claimed is:

1. An image forming apparatus comprising:

a fixing device, including two rotatable members that are pressed against each other, for fixing a toner on a recording paper; and a guide member for guiding the recording paper to which a toner has been transferred to a nip region between the two rotatable members, wherein a conductive or semiconductive region and an insulating region are sequentially arranged in a recording paper transport direction on a guide face of the guide member so that both of the conductive or semiconductive region and the insulating region are capable of contacting the recording paper which is transported therealong and so that the conductive or semiconductive region is disposed on an upstream side in the recording paper transport direction and that the insulating region is disposed on a downstream side in the recording paper transport direction, and the conductive or semiconductive region is grounded, and the insulating region includes an end portion of the guide member on the downstream side in the recording paper transport direction.

2. The image forming apparatus according to claim 1, wherein the insulating region is made of an insulating layer or an insulating sheet, and the conductive or semiconductive region is made of a conductive or semiconductive layer or sheet.

3. The image forming apparatus according to claim 1, wherein the conductive or semiconductive region is made of a flexible sheet that is conductive or semiconductive, and the guide member has a support face for supporting the flexible sheet, a step is provided between the support face of the guide member and the insulating region so that the insulating region is displayed from the support face of the guide member in a direction to move away from the recording paper being transported, and the flexible sheet is projected in the recording paper transport direction from the step.

4. The image forming apparatus according to claim 3, wherein the flexible sheet is projected to a point above the insulating region.

5. An image forming apparatus, comprising:

a fixing device, including two rotatable members that are pressed against each other, for fixing a toner on a recording paper; and a guide member for guiding the recording paper to which a toner has been transferred to a nip region between the two rotatable members, wherein a flexible resin sheet that is to be brought into contact with the recording paper and that is conductive or semiconductive is disposed on a guide face of the guide member, the flexible resin sheet is projected on a downstream side in a recording paper transport direction from an end portion of the guide member, and the flexible resin sheet is grounded.

6. The image forming apparatus according to claim 5, wherein at least one of the rotatable members is a heat roller having a built-in heat source, and the flexible resin sheet has a heat resistance of at least the surface temperature of the heat roller.

7. The image forming apparatus according to claim 5, wherein the flexible resin sheet is projected toward a surface of one of the rotatable members from the end portion of the guide member.

8. The image forming apparatus according to claim 5, wherein the guide member is formed by overlaying two conducting plates on each other, the flexible resin sheet is disposed on the guide face of one of the conducting plates, electrical continuity is established between the conducting plates by folding and holding part of the flexible resin sheet between the conducting plates, and the flexible resin sheet is grounded via the conducting plates.

9. The image forming apparatus according to claim 5, wherein the flexible resin sheet is disposed at least at a region with which the recording paper can be brought into contact, on the guide face of the guide member, and an entire front face of the flexible resin sheet is a smooth face.

* * * * *